United States Patent [19]

Dehan

[11] 4,249,727

[45] Feb. 10, 1981

[54] FRICTION TYPE GYMNASTIC APPARATUS

[75] Inventor: Charles J. M. Dehan, Montpellier, France

[73] Assignee: Etablissement Ariabel, Va.DUZ ; LIX

[21] Appl. No.: 941,747

[22] Filed: Sep. 12, 1978

[30] Foreign Application Priority Data

Sep. 15, 1977 [FR] France ..... 77 27907

[51] Int. Cl.[3] ..... A63B 21/22

[52] U.S. Cl. ..... 272/132; 272/143

[58] Field of Search ..... 272/132, 131, 143, DIG. 3, 272/72, 67, 109, 134, DIG. 4

[56] References Cited

U.S. PATENT DOCUMENTS

| | | | |
|---|---|---|---|
| 3,428,311 | 2/1969 | Mitchell | 272/132 X |
| 3,782,721 | 1/1974 | Passera | 272/132 |
| 3,802,701 | 4/1974 | Good | 272/131 |

FOREIGN PATENT DOCUMENTS

| | | | |
|---|---|---|---|
| 617163 | 11/1926 | France | 272/131 |
| 2239262 | 8/1973 | France | 272/131 |

*Primary Examiner*—William R. Browne

*Attorney, Agent, or Firm*—Neuman, Williams, Anderson & Olson

[57] ABSTRACT

Gymnastic apparatus designed to strengthen the muscles of the abdomen at waist level, those located in the small of the back and in the buttocks and to exercise and maintain all of the rest of the body's muscles, including a base, a bar which can be moved in any direction, one of whose ends is fitted with a sleeve, and whose other end is connected to the base by means of a connection mechanism.

The connection mechanism includes a ball holding the end of the bar which is housed in a tube whose upper end is shaped to match the upper end of the ball, with the lower end of the tube being secured to the base. Said ball can move in all directions in response to movement imparted to the ball, within a space limited by the upper end of the tube and by a part forming a seat for the ball mounted on the base by means of an adjustment mechanism making it possible to adjust friction of the ball.

1 Claim, 6 Drawing Figures

FRICTION TYPE GYMNASTIC APPARATUS

SUMMARY OF THE INVENTION

This invention involves a gymnastic apparatus intended to strengthen the muscles of the abdominal area at waist height, as well as muscles located in the small of the back and the buttocks.

Many types of apparatus intended to exercise abdominal muscles are on the market today, i.e. exercycles or similar devices. However, apparatus of this type only act upon a few muscles. Furthermore, they are fairly expensive and take up quite a bit of space, making them practically unusable for apartment dwellers.

We are also familiar with smaller apparatus of the sort including a base and a bar which may be moved in all directions. One of the ends of the bar is fitted with a sleeve, while the other end is connected to the base by means of springs or hydraulic cylinders. However, equipment available today is so designed that the effort which must be exerted by the person taking exercise to move the bar cannot be adjusted to match the person's build.

Furthermore, the required effort mentioned above is not uniform for all possible movements of the bar because of the variety of torques created when the bar is slanted at different angles. This is why this type of equipment has not been successfully marketed.

The purpose of this invention is to correct these drawbacks and develop a gymnastic apparatus intended to train almost all of the body's muscles, and in particular, to strengthen abdominal muscles at waist level, and muscles in the small of the back and buttocks. This invention, which takes up little space and is not very expensive, offers continuous resistance to movements of the bar in all directions, and makes it possible to adjust said friction depending upon the build of the person taking exercise.

In order to achieve this, this invention involves an apparatus of the type mentioned above which is essentially characterised by the fact that the means of connection described above includes a ball fitted to the end of the bar housed in a tube whose upper end is shaped to fit the upper portion of the ball. The bottom end of said tube is secured to the base, and the ball is capable of moving in all directions as a result of movement imparted to the bar within a space limited by the upper end of the tube and by a part forming a seat for the ball mounted on the base by means of a device for adjusting friction created by movement of the ball.

One can readily conceive that thanks to this arrangement, perfectly continuous friction of the bar is achieved in all directions of movement.

Furthermore, the device used to adjust friction includes a wedge fitted with an inclined plane which acts in conjunction with a matching inclined plane on the part forming a seat for the ball. This wedge can slide laterally along a threaded shaft controlled by a wheel.

Consequently, by turning the wheel one moves the wedge. The inclined plane on the wedge presses against the part forming a seat for the ball, and increases the pressure exerted by the latter on the spherical concave parts of the shaped tube. The adjustable effort exerted on the ball requires controlled muscular effort in the form of twisting movements made by muscles located in the small of the back. In other words, the greater the pressure exerted by the ball on the concave spherical parts, the more effort must be exerted by the person taking exercise. The friction of the ball can thus be adjusted at will consequently modifiying the effort that must be exerted so as to accommodate the build of the person taking exercise.

Furthermore, the ball is made up of two cast cups which fit into one another.

Furthermore, the bar is secured to the ball by means of a threaded bolt which may be screwed into a plug integral with the bar. The polygonal bolt head is set into the central sockets of the two cups in such a manner that it drives them by its own movement.

Another advantage consists in the fact that said bar includes two telescoping tubes which may be locked at the desired length by means of a securing device.

In a preferred form of the invention, this device consists in a tapped ring which may be screwed onto the threaded cylindrical portion of a sleeve fastened to the tube with the largest diameter until such point as it is stopped by the conical part of said sleeve.

One can readily conceive how, thanks to this arrangement, the bar may be locked at the desired height as determined by the user's own height simply by rotating the tapped ring.

Lastly, said sleeve is mounted such as to rotate freely around the upper end of the bar, doing away with any friction between the sleeve and the user's hands.

BRIEF DESCRIPTION OF THE DRAWINGS

One way of building this invention is described below to serve as an example and a reference for the appended drawings of which.

Figure 1:
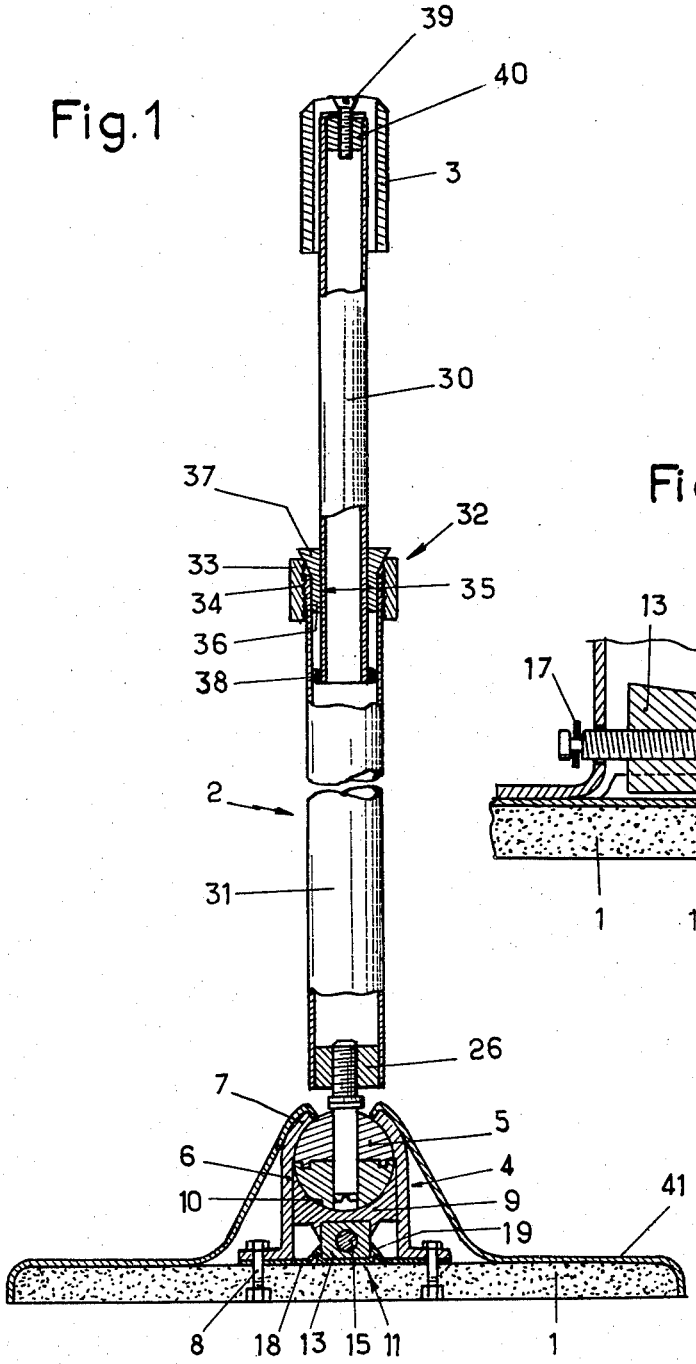
FIG. 1 is a vertical cross section along the axis of the bar of an apparatus as per this invention.
Figure 2:
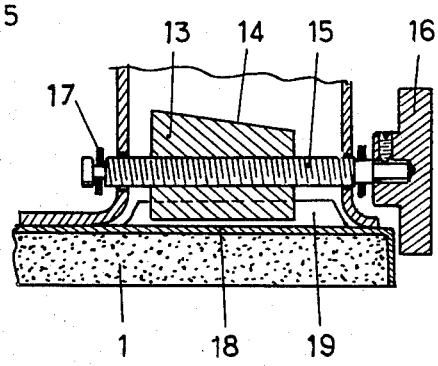
FIG. 2 is a cross sectional view on a larger scale of the arrangement used to adjust ball friction as per the invention.

The gymnastic apparatus represented on the drawings includes a base (1), a bar designated in its entirety by (2), which can be moved in all directions and is fitted at one of its ends with a sleeve (3). The other end of the bar is connected to the base (1) by means of connections designated in their entirety by (4).

As per this invention, the connection (4) includes a ball (5) lodged in a tube (6) whose upper end (7) is shaped to fit the ball (5). The lower end of said tube is secured to the base by means of bolts (8).

Ball (5) can move in all directions in response to movement imparted to bar (2) within a space limited by the upper concave part (7) of tube (6) and by a part (9) one of whose surfaces (10) is concave to form a seat for ball (5) while the opposite face (10') is sloped. This sloped face acts in conjunction with an adjustment mechanism designated in its entirety by (11).

Part (9) may successfully be composed of three parts e.g. an initial part (9') including the concave surface (10) forming a seat for the ball, a second part (9'') including the inclined face (10'), and a third part (9''') between the first two parts made from elastic material. Part (9') includes two stubs (a) which fit into holes (b) provided for this purpose in part (9''). Part (9''') made from elastic material also includes two holes which hold stubs (a).

The adjusting mechanism (11) includes a wedge (13) fitted with an inclined plane (14) which acts in conjunction with the inclined plane of part (9) forming a seat. Wedge (13) can slide laterally along a threaded shaft (15) controlled by a wheel (16). Shaft (15) is secured to tube (6) by means of clips or shoulders which prevent it from moving laterally while permitting rotation of the shaft alone. Part (18) with a double rib (19) guides wedge (13) in a lateral direction.

Figure 3:
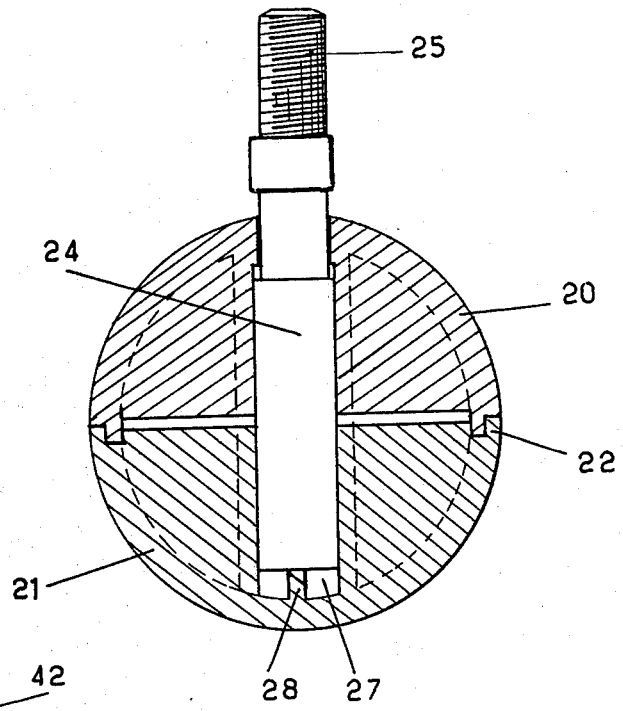
FIG. 3 is a cross sectional view on a larger scale of the ball appearing in FIG. 1.
Figure 6:
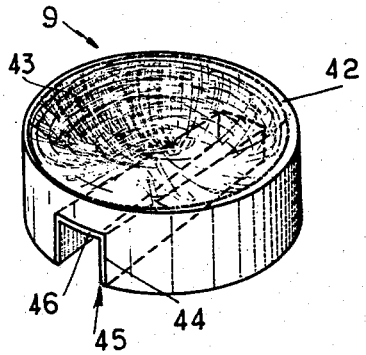
FIG. 6 is a three dimensional cut-away view of a ball seat variant.
Figure 4:
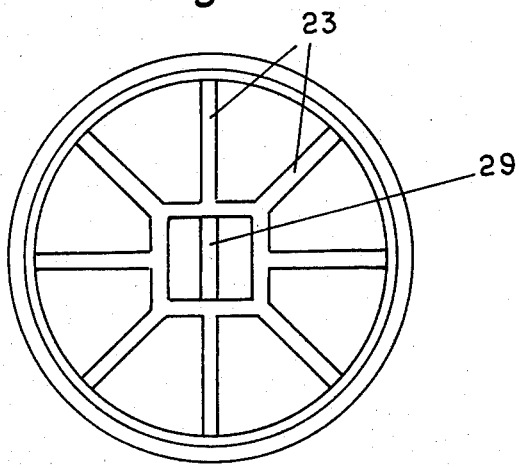
FIG. 4 is a view of one of the cups making up the ball.
Figure 5:
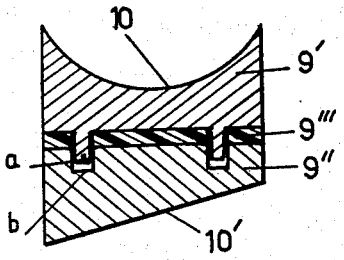
FIG. 5 is a view on a larger scale of the part forming a seat for the ball.

As can be clearly seen from FIG. 3 ball (5) is made up of two molded cups (20) and (21) which fit into one another at (22). These cups are also fitted with stiffening ribs (23).

This design of the ball is all the more advantageous in that it makes it possible to include a bar with a polygon-shaped section.

Bar (2) is secured to ball (5) by means of a bolt (24) with a square cross section, threaded at 25 and capable of being screwed into a plug (26) which is integral with the bar. The head (27) rests against a rib (28) which can bend if need be so that the head (27) fits into the housing of the sphere without there being any play.

It should be noted that bar (2) includes two telescoping tubes (30, and 31) which can be locked at the desired length by means of a securing mechanism designated in its entirety by (32). Securing mechanism (32) is a tapped ring (33) and a sleeve (35) including a cylindrical threaded part (36), a conical part (37) which is fastened to tube (31). The tapped ring (33) is screwed onto sleeve (35) until such point as it is stopped by its conical portion (37). Thus, to adjust the length of bar (2), one need only unscrew ring (33) so as to slide tube (30) inside tube (31) until the desired length is obtained, at which point ring (33) should be tightened back down.

In the same way, tube (30) may be completely disassembled from tube (31) when the apparatus is not in use. A stop (38) is provided for this purpose at the end of bar (30) in order to make it easier to guide the tubes.

Sleeve (3) is assembled in such a manner as to be free to rotate around bar (2) by means of screw (39) screwed into a plug (40) which is integral with the bar.

A plastic pad (41) is also provided to cover the shaped tube (6) and base (1).

The apparatus designed in this manner operates as follows. The user steps onto the pad (41) and adjusts the height of bar (2) to his own height by rotating the ring (33). He then grabs the bar (2) by its handle (3) and begins moving the bar in semi-circles or figure eights, as though he were sculling.

In order to adjust ball friction and increase the amount of effort required by the user to move the bar, one need only turn the wheel (16) clockwise, moving wedge (13) along the threaded shaft (15) by means of its inclined plane (14) and pressing upward on seat (9) of ball (5) thus increasing the amount of pressure it exerts upon the spherical parts (7) of the shaped tube (6).

In order to decrease the amount of effort required from the user's muscles, one need only turn the wheel (16) counter-clockwise.

Thus, the adjustable amount of effort expended to move the ball requires controlled action by muscles located in the small of the back, in the abdomen at waist height and in the buttocks. All of the body's muscles are exercised to a lesser extent.

It should be noted that when stood up on the floor, the apparatus as per the invention takes up very little space in a room, an office or a bathroom and allows the user to take a few minutes exercise at any time during the day without having to undress.

Furthermore, the design of this apparatus makes it easy to disassemble into at least three parts for storage of shipment by the post.

Even though the invention has been described in detail with reference to a specific design, it is understood that alterations and modifications may be made in said design without the resulting apparatus falling outside the scope of this invention. Thus, i.e. seat (9) of ball (5) could successfully be composed of a single part (42) in shaped steel whose upper portion is fitted with a hollow spherical bearing (43) housing the ball. Its lower part is fitted with a cylindrical skirt capable of sliding inside tube (6). Two shoulders like (44) are fitted on this cylindrical skirt. A U-bar (45) whose bottom (46) is inclined from the horizontal is fitted into the latter. This part (45) also serves to guide and support sliding wedge (13), ensuring adjustment of ball friction.

I claim:

1. Gymnastic apparatus for strengthening body muscles, comprising a base; a bar supported by said base; means connecting one end of said bar and said base for providing limited rotary movement of said bar relative to said base; the connecting means comprising a ball connected to one end of said bar and a socket for receiving said ball connected to said base; said bar comprising a plurality of interfitting parts whereby it may be adjustable in length; a wedge for engaging said connecting means and urging said socket against said ball and varying the force necessary to move said bar relative to said base; adjustable means connected to said wedge for moving said wedge relative to said socket; said ball having two substantially hemispherical bodies; each body having an opening therein of polygonal sectional configuration; a connector assembly interposed said bar and said ball received in said opening; said connector assembly comprising a bolt having a threaded end, and a nut means mounted on one end of said bar for engaging said threaded end; said bolt having an end of polygonal sectional configuration for interfitting with the ball opening of polygonal sectional configuration.

* * * * *